US006114632A

United States Patent [19]

Planas, Sr. et al.

[11] Patent Number: 6,114,632

[45] Date of Patent: Sep. 5, 2000

[54] INTEGRATED POWER AND DATA COMMUNICATION HYBRID CABLE ASSEMBLY FOR LOCAL AREA COMPUTER NETWORK

[76] Inventors: Alberto E. Planas, Sr., 901 SW. 37th Ave., Apartment 33, Miami, Fla. 33135; Alberto E. Planas, Jr., 227 Sarto Ave., Coral Gables, Fla. 33134

[21] Appl. No.: 09/259,965

[22] Filed: Mar. 1, 1999

Related U.S. Application Data

[60] Provisional application No. 60/076,849, Mar. 5, 1998.

[51] Int. Cl.[7] ..... H01B 7/00

[52] U.S. Cl. ..... 174/117 R; 174/120 R

[58] Field of Search ..... 174/70 R, 117 R, 174/50, 120 R, 107, 36, 113 R

[56] References Cited

U.S. PATENT DOCUMENTS

| | | | |
|---|---|---|---|
| 2,089,774 | 8/1937 | Wachstein | 174/117 R |
| 2,141,290 | 12/1938 | Carlson et al. | 174/107 X |
| 2,180,731 | 11/1939 | Dickinson | 174/117 R |
| 2,391,036 | 12/1945 | Rasmussen | 174/117 R |
| 2,583,025 | 1/1952 | Swift et al. | 174/113 R |
| 3,123,765 | 3/1964 | Julie | 174/107 X |
| 3,328,510 | 6/1967 | White | 174/117 R |
| 4,284,841 | 8/1981 | Tijunelis et al. | 174/107 X |
| 4,453,031 | 6/1984 | Justiss | 174/36 |
| 4,956,523 | 9/1990 | Pawluk | 174/70 R |
| 5,371,823 | 12/1994 | Barrett et al. | 174/70 R |
| 5,414,217 | 5/1995 | Neuroth et al. | 174/120 R |
| 5,448,669 | 9/1995 | Dunn et al. | 174/117 R |
| 5,451,718 | 9/1995 | Dixon | 174/107 X |

*Primary Examiner*—Dean A. Reichard

*Attorney, Agent, or Firm*—Watts, Hoffmann, Fisher & Heinke, Co., L.P.A.

[57] ABSTRACT

An integrated power and data communications hybrid cable assembly for local area computer network is disclosed. The network includes a hybrid cable integrating both power supply and data communications into one physical cable. For each computer workstation served, a length of cable extends between a panel and an outlet. The panel includes a cabinet defining an interior region and an interior barrier dividing the cabinet interior region into a power section and a data section. The interior barrier includes barium ferrite to magnetically isolate the data section from the power section. The hybrid cable is electrically coupled between an outlet and the panel to provide power to a computer workstation electrically coupled the outlet and to provide for data transfer between the panel and the computer workstation. The hybrid cable includes a first group of one or more conductors for supplying power; a second group of one or more conductors for transmitting voice or data signals; a first insulation sheath enclosing the first group of one or more conductors for insulating the second group of one or more conductors from a magnetic field produced by the first group of one or more conductors; a second insulation sheath, similar in construction to the first insulation sheath, enclosing the second group of one or more conductors; and a third insulation sheath enclosing both the first and second insulation sheaths. The outlet includes power and data female connectors adapted to receive a male connectors from a computer workstation device.

26 Claims, 5 Drawing Sheets

INTEGRATED POWER AND DATA COMMUNICATION HYBRID CABLE ASSEMBLY FOR LOCAL AREA COMPUTER NETWORK

This application claims the benefit of the Mar. 5, 1998 filing date of U.S. Provisional Application Ser. No. 60/076,849, which is herein incorporated by reference.

We live our lives at a pace which will never match that by which data flows from one computer source to another. Our considerable dependence on that speed-of-light flow of information down a technological highway we can neither see nor touch, is apparent in every aspect of human interaction today. Virtually all businesses, schools, hospitals and homes rely on the quick, accurate transferal of data from work stations, to servers, to mainframes, to remote locations. Today, local area networks (LAN) provide the means to communicate within these facilities.

After carefully studying and analyzing the intricate design of power and data distribution systems, the inventions outlined in this patent application will provide the capacity to link data, telecommunication, and electrical power together in one separate cable; thus, revolutionizing computing and facilitating access to data in the private sector, as well as telecommunication, engineering, and computer industries. For the first time in history, computer work stations will be fed electricity and data through one hybrid cable, as opposed to what today's technology provides: cumbersome and difficult wiring with separate lines for data, telephone, fax and electrical power. The expertly designed Planas Cable, a hybrid cable which would be the sole conduit for both data, telephone and power lines, will feed the computer with power, without interrupting or interfering with data flow. The electrical panel called the Planas Panel, will provide the necessary electrical power for this historic link-up and will serve as a hub for data, the common point of connection for the Planas Network, the interconnection with many computers, both on site or connected to the World Wide Web.

Typically, the power supplied to computers and sensitive electrical equipment contains harmonics, transient spikes, and glitches known as "noise", all of which render a power source "unclean". Currently, the problem of supplying "clean power" is being analyzed extensively in today's technology community of electrical engineers and computer designers. Though some researchers in these fields are in the process of designing filters to eliminate "noise" from power, data and telecommunications cables, an exhaustive patent search revealed that no one has created nor attempted to create a system that would supply both power, data, and telecommunication connections through one cable.

By simplifying connections and eliminating the tangled knot of computer cables found at virtually all computer work stations today, the Planas Cable, the Planas Electrical Panel, and the Planas Network will greatly benefit individual and business computer users. The Planas Cabling System offers and ideal solution for any buildings' power, data and telecommunication requirements, because it is safe, cost-effective, and easy to operate. Schools, hospitals, homes and businesses, whether new sites or old, whether being newly fitted or retrofitted, will profit from the Planas Cabling System's flexibility and reliability.

The Planas Cabling System consists of a panel, a hybrid cable, an outlet box and a computer plug. All of these components will create a network unlike anything existing today, eliminating messy wiring and avoiding the many problems involved with running data cables and telecommunication cables through sub-floors and ceiling spaces.

The Planas Cable: made of barium ferrite, this unique, nonflammable, flexible cable is magnetic, which allows it to cancel out the magnetic field created by electricity flowing through power cables. This insulation eliminates the influence of the magnetic field, which, until the invention of this cable, has been the main reason why power and data sources have never been run together on the same cable. The Planas Cable will provide complete insulation and protection for data.

The Planas Panel: is an electrical panel which supplies power and acts as a network hub to the Planas Network, thus combining data/power together.

The Planas Outlet Box: is a junction box split in three sections. One section is for splicing and the other two are for data and power, thus combining data & power together at one point.

The Planas Plug: is a plug for computer equipment. It replaces all existing computer plugs that are used today. This prevents anything else besides a computer to be plugged into this Planas Network.

The Planas Network: for the first time combines power and data and transmits it through the same medium, thus, facilitating, simplifying and reducing the cost of today's networking.

FIGS. 1A, 1B, 1C, 1D, 1E, 1F, and 1G show the Planas Panel.

FIGS. 2A, 2B, and 2C show alternate Planas Panels. Here we show different possible arrangement of the allocation of the data hub.

Figure 6:
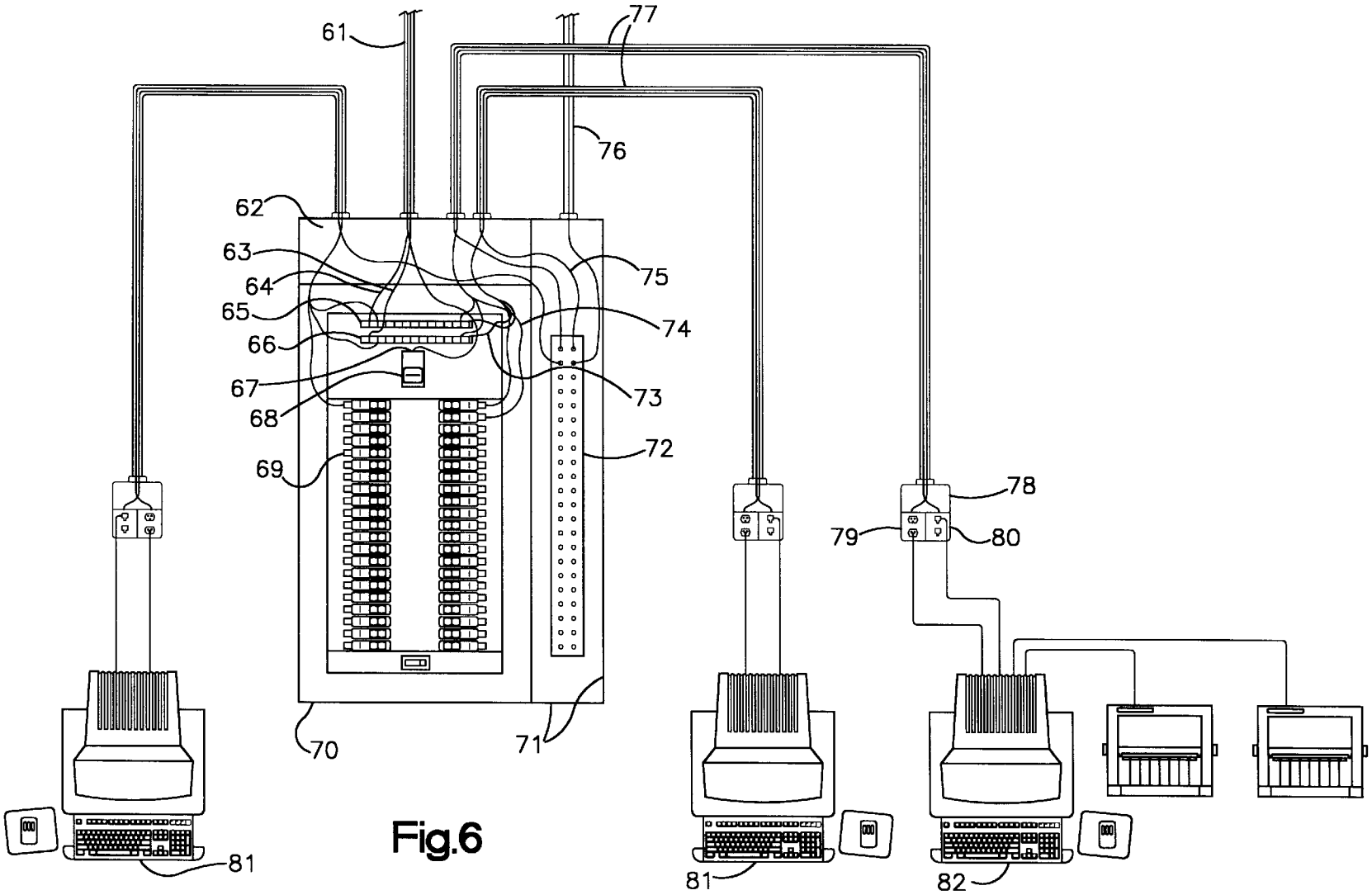

FIG. 6 shows the Planas Network. This figure demonstrates how all the above parts work together. Here you can see for the first time the power of this system.

Figure 7:
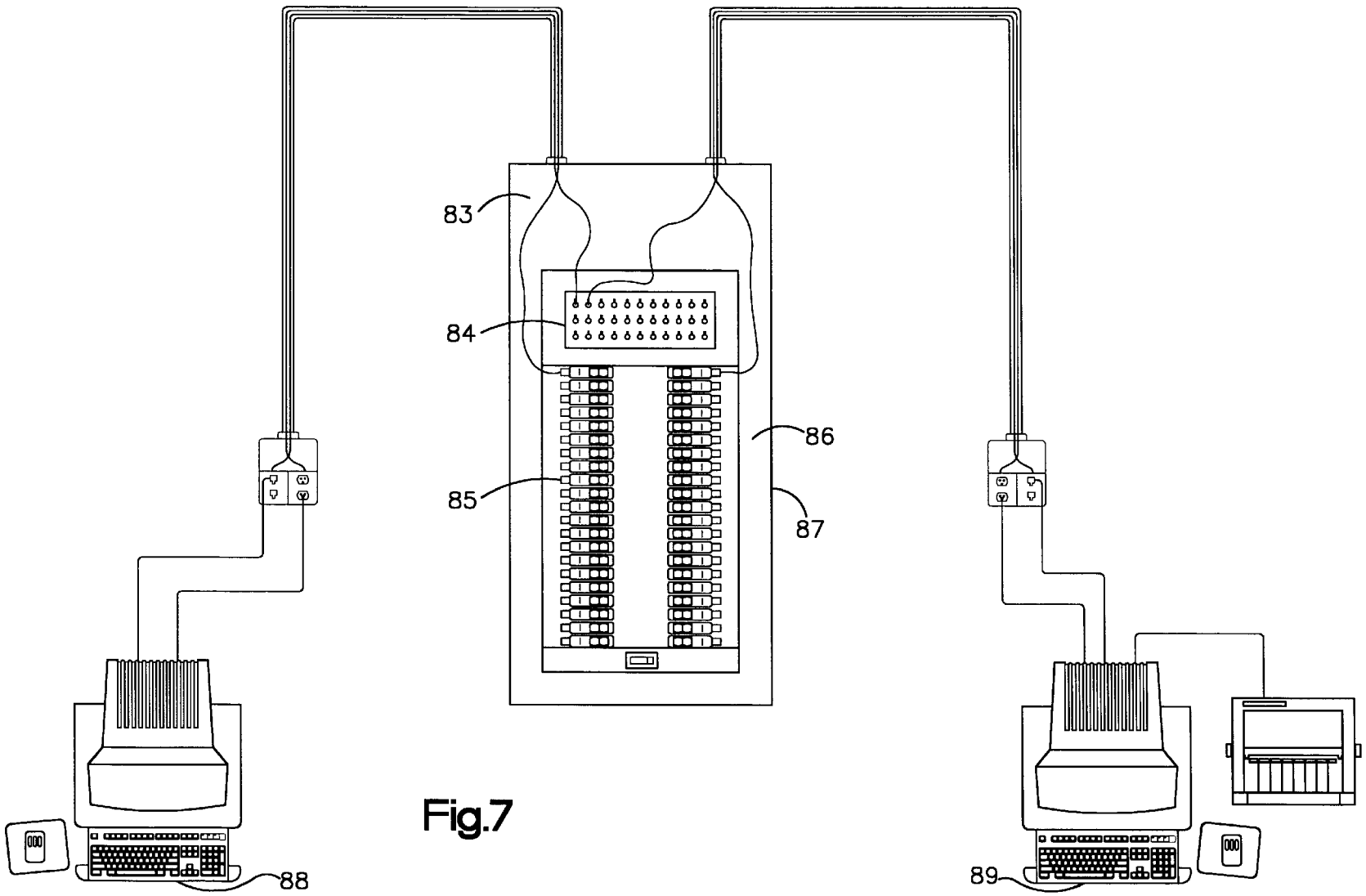

FIG. 7 shows the Planas Network with an alternate Planas Panel.

Figure 8:
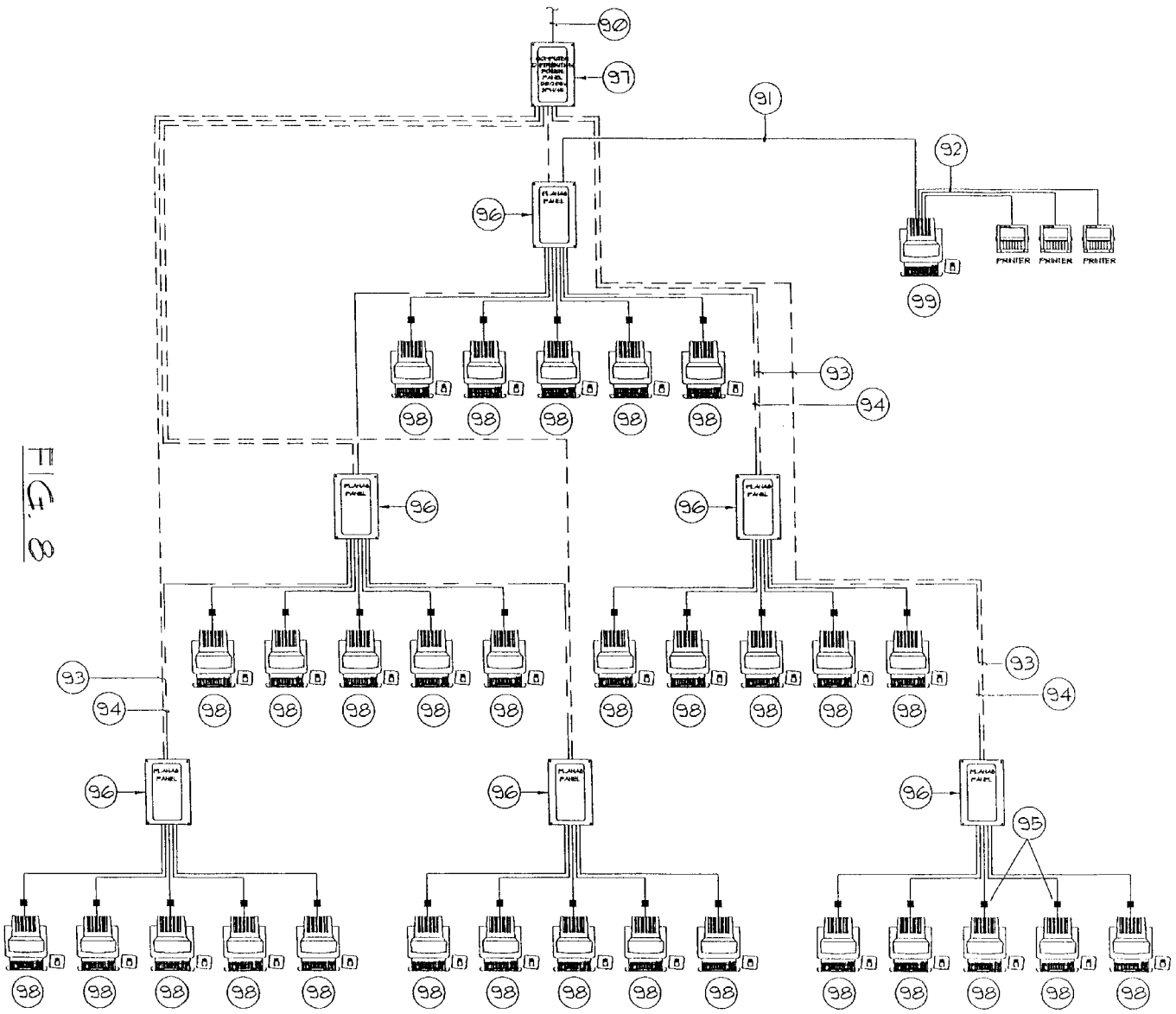

FIG. 8 shows the Planas Network extended. This is how the system could be used in a hospitals, office buildings, etc. Here you can see how a different branch in the electrical field will be created.

FIG. 1: The Planas Panel

Item 1: Front view of cabinet interior.

The Planas Panel Assembly shall be enclosed in a galvanized steel cabinet. The size of the wiring gutters and gauge of steel will be in accordance with "NEMA" Standards Publication and U.L. Standards No. 67 for electrical panelboard. This cabinet will be NEMA 1, flush or surface mounted. The dimensions of the cabinet will be 26 inches wide by 60 inches high by 6 inches deep.

Item 2: Plastic with barium ferrite barrier to separate panel power section from voice/data section.

Item 3: Circuit breakers mounting pan.

Item 4: This power panel section is rated only at 120/208 V., three phase (3PH), four wires (4W).

Item 5: Branch circuit thermal-magnetic molded case circuit breakers, each circuit breaker will be 120 volts, one pole (1P), with a setting of twenty amperes (20A) or thirty amperes (30A) trip with a short circuit rating of 10 k or 22 k. "RM S" symmetrical amperes. All circuit breakers will be bolt-on mounted type. Individual quantity of circuit breakers will be up to 42. These circuit breakers are serving and protecting the computer's power service.

Item 6: Main thermal-magnetic molded case circuit breaker. This main breaker will be 208 volts, three phase (3PH), three poles (3P), with a wide range of ampere settings up to 400 amperes. Circuit breaker trip with a short circuit rating from 10 k to 100 k "RMS" symmetrical amperes. This main breaker is vertically mounted and barrier with lugs suitable for copper feeder serving this panel. The function of this main circuit breaker is to give overcurrent protection as well as short circuit protection to the Planas Panel, also to disconnect this panel from power if need be, for maintenance.

Item 7: Solid neutral assembly (copper bar) mounts in the main circuit breaker compartment but electrically isolated from breaker and panel cabinet. These assembly lugs are provided for copper conductors which terminate the neutral circuit coming from each computer.

Item 8: Isolated ground copper bar isolated from panel cabinet for the termination of the isolated grounding conductor coming from each computer outlet.

Item 8 a: Equipment ground copper bar bonded to panel cabinet for the termination of the equipment grounding conductor coming via conduit from computer outlet.

Item 9: Data service hub of TJ-4S or co-ax terminal to link together each computer to the data system. This hub will serve up to 42 computers.

Item 10: Insulation pasted in all sides including panel cover plate of data section. This insulation is made of barium ferrite with a minimum thickness at voice/data any point of 30 mils, a magnetic flexible material nonflammable which will cancel out the magnetic field created by electricity in the power section.

Item 11: For complete flexibility of power and data conductors, into respective section, holes with rubber bushing are provided to avoid conductor insulation damage.

Item 12: Six (6) mounting holes are provided to attach the cabinet to the wall.

Item 13: Planas Panel cabinet side view.

Item 14: Feeder knockout in both sides to serve main circuit breaker.

Item 15: Planas Panel cover plate with opening as shown.

Item 16: Branch circuit breaker opening.

Item 17: Main circuit breaker opening.

Item 18: Planas Panel front door. Door will be equipped with three point latch. Door will be mounted by completely concealed steel hinge.

Item 19: Flush, brushed stainless steel, cylinder tumbler-type locks with catches and spring-loaded door pulls. The flush lock will not protrude beyond the front of the door.

Item 20: Power circuit for each branch circuit breaker directory frame and card with a clear plastic covering will be on the inside of the door.

Item 21: Data circuit for each computer serve by the hub directory frame and card with a clear plastic covering will be on the inside of the door.

Item 22: Top endwall cabinet for Planas Panel.

Item 23: Typical concentric knockouts (¾") for complete flexibility of conduit entrance into cabinet of Planas Panel, to serve branch circuit breaker and branch service hub.

Item 24: Bottom endwall cabinet of the Planas Panel. Item 25: Concentric knockout (1", 1¼ ", 1½", 2, 2½", 3" & 3½") for complete flexibility of feeder entrance into cabinet of the Planas Panel to serve main circuit breaker.

Item 26: Cabinet section.

Item 27: Service hub mounting pan isolated from cabinet of Planas Panel.

Item 28: Power section plated copper bus bars structure (3-bars, one for phase "A", one for phase "B" and another one for phase "C") are assembled onto the interior pan in a single, vertical stack, supported continuously by molded polyester glass insulators.

Figure 1A:
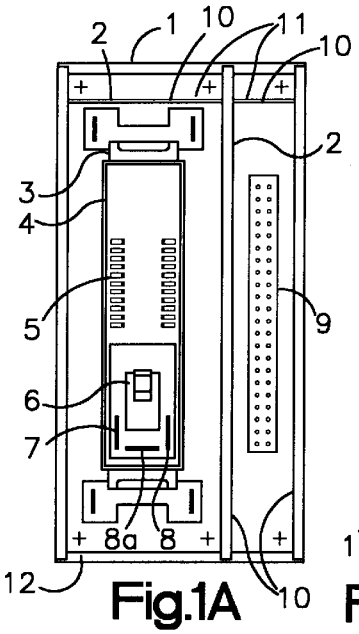
Figure 1B:
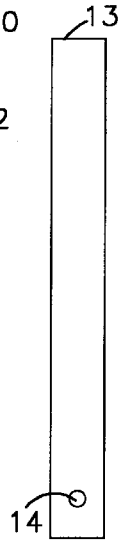
Figure 1C:
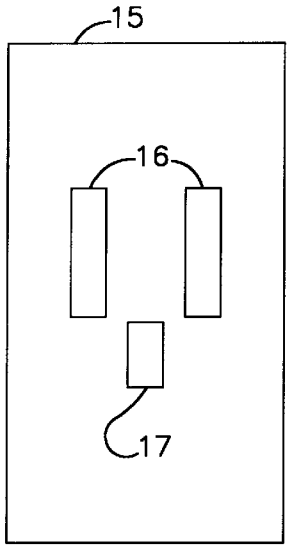
Figure 1D:
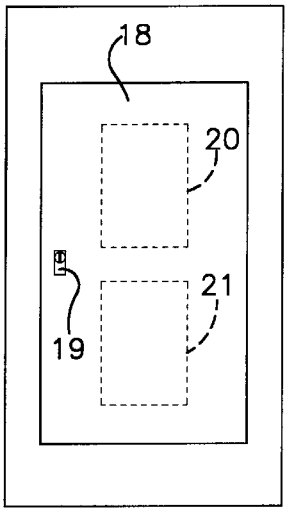
Figure 1E:
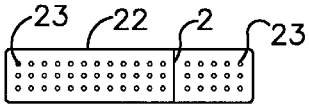
Figure 1F:
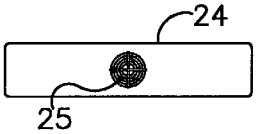
Figure 1G:
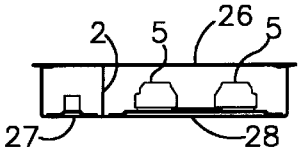
Figure 2A:
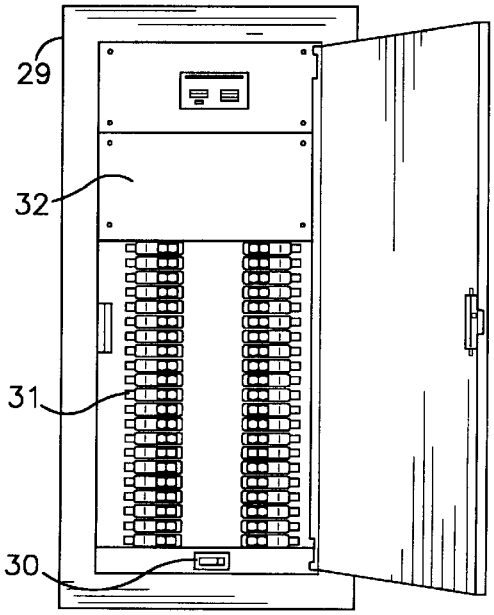
Figure 2B:
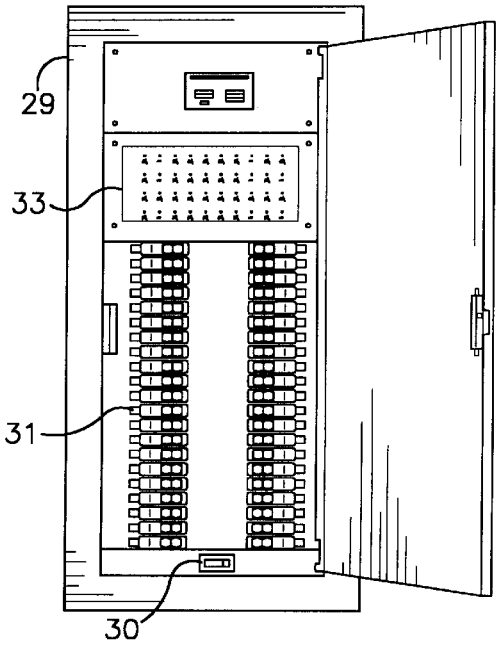
Figure 2C:
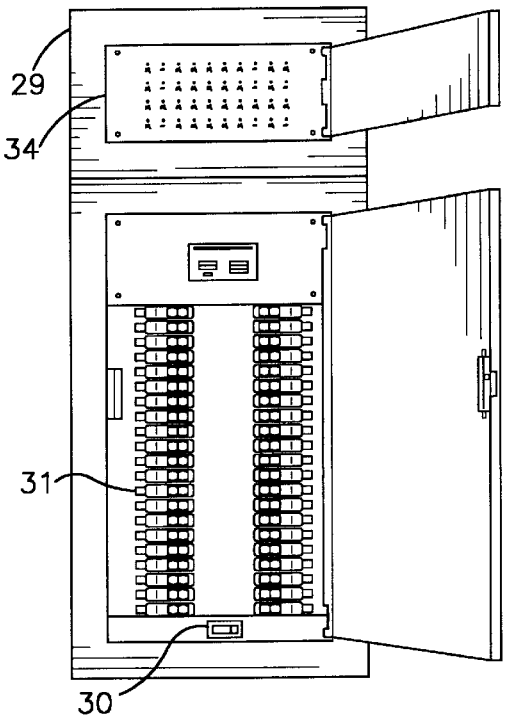

FIG. 2: Alternate Planas Panels

Item 29: Front view of Planas Panel. The size of the wiring gutters and steel gauge will be in accordance with "NEMA" Standards Publication and "UL" Standards No. 67 for electrical panelboards. This panel will be inside of NEMA 1 cabinet, flush or surface mounted. The dimension of panel inside cabinet will be 20 inches wide by 72 inches height by 6 inches deep.

Item 30: Main thermal-magnetic molded case circuit breaker. This main breaker will be 208 volts, three phase (3pH), three poles (3p), with a wide range of ampere settings up to 400 amperes. Circuit breaker trip with a short circuit rating from 10 k to 100 k "RMS" symmetrical amperes. This main breaker is vertically mounted and barrier with lugs suitable for copper feeder serving this panel. The function of this main circuit breaker is to give overcurrent protection as well as short circuit protection to the Planas Panel, also to disconnect this panel from power if need be, for maintenance, reconnections of new branches, etc.

Item 31: Branch circuit thermal-magnetic molded case circuit breakers, each circuit breaker will be 120 volts, one pole (1P), with a setting of twenty amperes (20A) or thirty amperes (30A) trip with a short circuit rating of 10 k or 22 k "RMS" symmetrical amperes. All circuit breakers will be "bolt-on" mounted type, individual. Quantity of circuit breakers will be up to 42. These circuit breakers are serving and protecting the computer's power service.

Item 32: Data service hub of RJ-45 or co-ax terminal to link together each computer to the data system. This hub will serve up to 42 computers. This hub is provided with a screw-on cover plate.

Item 33: Similar to item 32, except without cover plate.

Item 34: Similar to item 32, except with a hinged door.

Figure 3A:
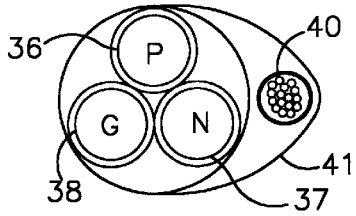
FIGS. 3A and 3B show the Planas Cable. This sketch demonstrates how the data and power cables run together within the barium ferrite insulation.

FIG. 3A: The Planas Cable Section

Item 35: The Planas Cable is a hybrid cable that serves as transmission and distribution routes for electrical energy and voice/data signal also, and will be used as a general purpose power/voice/data cable in accordance with the National Electrical Code (N.E.C.), with a maximum conductors temperature of 80 Deg. C. in dry locations and 75 Deg. C. in wet locations and 300 volts insulation for installation in conduit or other recognized raceway system. The wires will be cabled together without fillers to form a round compact core. This cable contains four (4) conductors arranged in two groups. Group one will consist of three (3) individually insulated copper stranded conductor, covered and protected by insulated jacket, to serve power system at computer station. Group two will consist of (6) 6-pair of copper shielded twisted pair, serving the voice/data system at computer station. Both groups (all conductors) will be covered and protected by an outer insulated jacket. This outer jacket will be smooth and of good appearance. This jacket will be easily stripped from the Planas Cable; but will be tight enough to permit drawing the Planas Cable around sharp bends without the jacket sliding along the core or breaking.

This cable will bear the Planas trade mark either embossed or printed on the cable and shall be finished in a white color.

This cable creates a new type of branch circuit that we called the "Planas Branch Circuit", that is a branch circuit supplying energy (power/data) to one outlet, the "Planas Outlet" (see FIG. No. 5), serving the computer station. Planas Branch Circuit will supply only one computer station.

Item 36: Current-carrying conductor (power or phase conductor) to serve power system at computer station.

Item 37: Neutral conductor, this conductor will carry only the unbalanced current from the current-carrying conductor of the same circuit. Also, this conductor will have sufficient current-carrying capacity to prevent the build-up of voltages that may result in undue hazards to connected computer equipment or to persons.

Item 38: Isolated grounding conductor, this conductor will connect the grounding terminal of the receptacle, that will have the equipment grounding terminal isolated from the mounting strap from the Planas Outlet Box and the Planas Panelboard ground bus bar. The purpose of this conductor is to reduce electrical noise (electromagnetic interference).

Item 39: PVC (polyvinyl chloride) insulation belongs to the thermoplastic family of insulation, and sheathed with barium ferrite.

Item 40: Data conductor to serve the data system at computer station.

Item 41: Outer "PVC" (polyvinyl chloride) jacket overall.

Figure 3B:
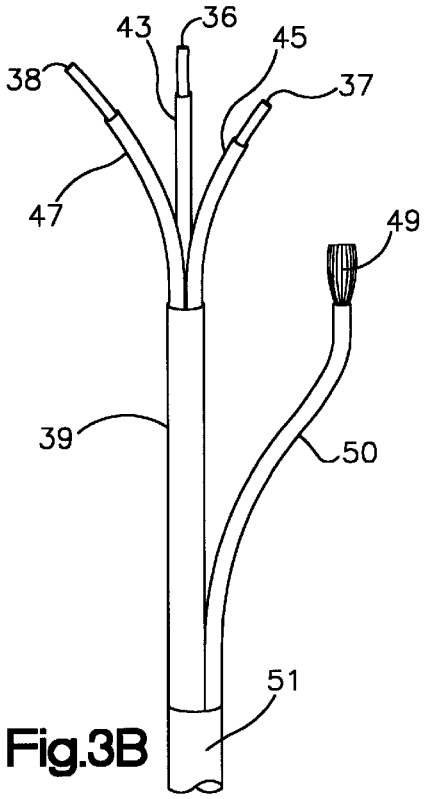

FIG. 3B: Planas Cable Composition Detail

Item 36: Power conductor is an annealed uncoated copper stranded conductor with 19 strands. This conductor size will be No. 12 AWG (American Wire Gauge) or No. 10 AWG. The load current rating and the overcurrent protection (circuit breaker) at the Planas Panel will not exceed 20 amperes for 12 AWG. or 30 amperes for No. 10 AWG. These ampacities are based per N.E.C. (National Electrical Code) for not more than three carrier current conductor in a conduit or any other type of raceway system.

Item 43: The power conductor 36 will be insulated with an organic compound insulating material such as "PVC" and sheathed with nylon, 300 volts complying with the requirements of U.L. Standard 83 for type "THHN" (flame retardant, heat resistant thermoplastic) or "THWN" (flame retardant, moisture and heat resistant thermoplastic). The "THHN" insulation will have a maximum conductor temperature of 80 Deg. C. and 30 Deg. C. ambient in dry locations. The "THWN" insulation will have a maximum conductor temperature of 75 Deg. C. and 30 Deg. C. ambient in wet or dry locations. The color of this insulation will be black.

The minimum thickness at any point of "PVC" and nylon insulation, for No. 12 AWG. conductor will be 20 mils (1 mil=0.001 inch) and for No. 10 AWG. conductor will be 25 mils. The minimum thickness at any point of the nylon sheath will be 4 mils for each conductor size (No. 12 & No. 10). The PVC and the nylon sheath will complied with the requirements of UL Standard 83 for types THHN/THWN. The PVC insulation and nylon sheath will be tightly to the conductor and to each other and will be free-stripping.

Item 37: Neutral conductor is an annealed uncoated copper stranded conductor with 19 strands. This conductor size will be No. 12 AWG. or No. 10 AWG. The load current rating of this conductor will not exceed 20 amperes for 12 AWG and 30 amperes for 10 AWG. These ampacities are based per N.E.C. for not more than three carrier current conductor in a conduit or any other type of raceway system.

Item 45: Similar to item 43 above, except that the color insulation will be white.

Item 38: Isolated grounding conductor is an annealed uncoated copper stranded conductor with 19 strands. This conductor size will be No. 12 AWG or No. 10 AWG. The current rating of this conductor will not exceed 20 amperes for 12 AWG. and 30 amperes for 10 AWG. This conductor size are based in the size of the overcurrent protection (circuit breaker) at Planas Panel.

Item 47: Similar to item 43 above, except the color insulation will be green.

Item 48: These power conductors (phase, neutral and isolated grounding) will have a sheath system which includes a "PVC" (polyvinyl chloride) flame retardant with another protective layer of barium ferrite, with a minimum thickness at any point of 20 mils for the "PVC" and 30 mils for the barium ferrite layer, to isolate the magnetic flux to the voice/data cable for any type of interference.

Item 49: Two types of telecommunications voice/data wiring are appropriate to be used with the Planas Cable. The first type consists of high quality 6-pair of unshielded twisted pair 24 gauge (AWG) "PVC" insulated solid copper conductors with performance capacity of up to 100 MHz. The thermoplastic insulation thickness will be 10 mils, called "UTP".

Each of the 12 conductors contained within this cable will be color coded and terminated in accordance with the EIA/TIA T568B polarization sequence. (EIA=Electronics Industries Associations; TIA=Telecommunications Industry Associations.)

The resistance of any conductor should not exceed 28.6 ohms per 305 m. (1000 ft.). The unbalanced resistance between any two conductors of any pair should not exceed 5% of the mutual capacitance of any one pair at a frequency of 1 kHz should not exceed 17 nf per 305 m. (1000 ft.) The unbalanced capacitance to ground at 1 kHz of any pair should not exceed 1000 ft. per 305 m. (1000 ft.).

The second type consists of fiber-optic (FO) cable such as, the use of FO cabling in the Planas Cable will be "optional". When used the FO cable will have dual strand, 62.5/125 micron core/cladding diameter multimode graded index fiber, will comply with all relevant applicable local standards for building and electrical material and construction. The total number of fiber strands will be a minimum of four (4). When the FO is used the sheathed will be of orange color to help distinguish fiber media from other premises wiring. This FO cable will have an operating wavelengths of 850 and 1300 nm., the maximum attenuation of −3.75 db/km @ 850 nm. and −1.5 db/km @ 1300 nm., the minimum bandwidth will be 160 MHz-km @ 850 nm. and 500 MHz-km @ 1300 nm.

Item 50: This voice/data conductors are enclosed by an overall flame retardant "PVC" sheath with a minimum thickness at any point of 35 mils. This sheath will be rated for 300 volts with a maximum conductor temperature of 80 Deg. C. and 30 Deg. C. ambient in dry and wet location. This "PVC" will have another protective layer of barium ferrite, with a minimum thickness at any point of 30 mils, to isolate the magnetic flux to the voice/data cable for any type of interference.

Item 51: The assembled conductors (power/voice/data) shall be completely enclosed in a "PVC" protective flame retardant, sunlight-resistant jacket. This jacket will be rated for 300 volts with a minimum thickness at any point of 35 mils. The overall outside diameter of this cable (Planas Cable) will be around 0.65 inch. The ultimate breaking strength of the complete cable will be 40.82 kg, or 90 lbs. minimum to withstand applied force before breaking or incurring damage. This cable will withstand a bend radius of 25.4 mm (1 inch) minimum at a temperature of −20 Deg. C. The maximum allowable length from the Planas Panel to the Planas Outlet will be 90 meters (295 ft.).

Figure 4A:
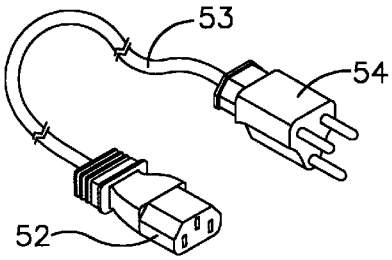
FIG. 4 shows the Planas Plug for computers. Here you can clearly see the three prong plug differing from existing plugs.
Figure 4B:
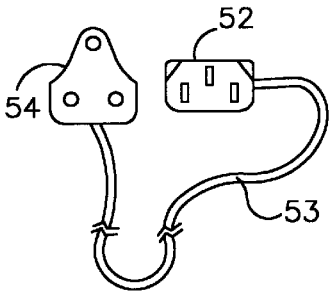

FIG. 4: The Planas Plug/Cordset

Item 52: Female plug, isolated ground, orange nylon body, 10 amperes, 125 volts, 1250 watts, AC current, to be used with straight blade.

Item 53: Cord, three (3) conductors shielded (phase, neutral & isolated ground) No. 18 AWG (3C/18) type "SVT" cord of orange color.

Item 54: Male plug, isolated ground, orange nylon body, 15 amperes, 125 volts, AC current, to be used with 3 round blades.

Figure 5A:
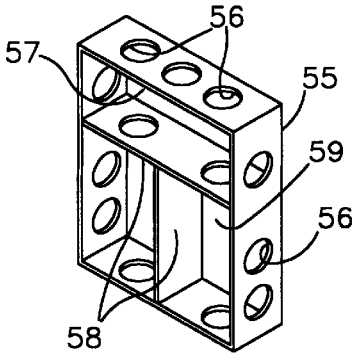
FIG. 5 shows the Planas Outlet. It is demonstrated here, the two different sides of the box one side for power and the other for telecommunications (voice/data).
Figure 5B:
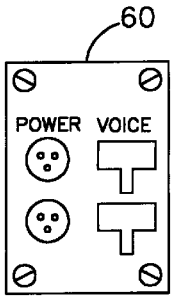

FIG. 5: The Planas Outlet

Item 55: The Planas Outlet shall be galvanized, code-gauge metal and will be 6 in. h.×4 in. w.×2.5 in. d.

Item 56: Denotes ¾ inch knockouts, for future conduit installation.

Item 57: Wiring compartment from conduit to respective devices.

Item 58: Plastic with barium ferrite barrier to separate outlet power section from voice data section.

Item 59: Insulation pasted in all sides including outlet cover plate of voice/data section. This insulation is made of barium ferrite with a minimum thickness at any point of 30 mils, a magnetic flexible material non-flammable which will cancel out the magnetic field created by electricity in the power section.

Item 60: Common plastic wall plate of orange color, smooth, dust-resistant surface, with color-matched mounting screws.

FIG. 6: The Planas Network

Item 61: Feeder in metal conduit to computer distribution power panel.

Item 62: Service cables section.

Item 63: Feeder neutral (typical).

Item 64: Feeder isolation ground (typical).

Item 65: Ground bus bar.

Item 66: Neutral bus bar.

Item 67: Feeder—Phase A, Phase B, Phase C.

Item 68: Main circuit breaker (when applicable).

Item 69: Branch circuit breakers (typical).

Item 70: Planas Panel metal can. See FIG. 1.

Item 71: Barium ferrite Planas insulation covering service cable section.

Item 72: Data plug-in service hub.

Item 73: Branch circuit neutral.

Item 74: Branch circuit ground.

Item 75: Telecommunication (voice/data) cable.

Item 76: Telecommunication cable in metal conduit to nearest upstream Planas Panel.

Item 77: Planas Cable running in metal conduit. See FIG. 3.

Item 78: Planas Outlet device. See FIG. 5.

Item 79: Power receptacle.

Item 80: Telecommunication receptacle.

Item 81: Work station.

Item 82: Network server.

FIG. 7: Alternate Planas Network

Item 83: Splice box/pull box.

Item 84: Alternate data plug-in service hub.

Item 85: Branch circuit breakers (typical).

Item 86: Cable through.

Item 87: Planas Panel metal can.

Item 88: Work station.

Item 89: Network server.

FIG. 8: Extended Planas Network

Item 90: To main distribution panel.

Item 91: Planas Cable in conduit serving network server.

Item 92: Typical serial cable serving printers.

Item 93: Feeder in metal conduit serving power to Planas Panel (typ.).

Item 94: Telecommunication cable in metal conduit serving Planas Panel.

Item 95: Planas Outlet (typical). See FIG. 5.

Item 96: Planas Panel. See FIG. 1.

Item 97: Computer distribution power panel.

Item 98: Work station (typical).

Item 99: Network server.

In the foregoing description, the invention has been described with reference to specific exemplary embodiments thereof It will, however, be evident that various modifications and changes may be made thereto without departing from the broader spirit or scope of the present invention as defined in the appended claims. The specification and drawings are, accordingly, to be regarded in an illustrative rather than a restrictive sense.

What is claimed is:

1. A hybrid cable electrically coupled between a panel and an outlet and providing for power transmission or bower distribution and data or voice communications between the panel and a computer workstation electrically coupled to the outlet, the hybrid cable comprising:

(a) a first group of one or more conductors for supplying power;

(b) a second group of one or more conductors for transmitting voice or data signals;

(c) a first insulation sheath enclosing the first group of one or more conductors for insulating the second group of one or more conductors from a magnetic field produced by the first group of one or more conductors, the first insulation sheath comprising an inner layer of organic compound material overlaid by an outer layer of magnetic material;

(d) a second insulation sheath enclosing the second group of one or more conductors for additionally insulating the second group of one or more conductors from the magnetic field produced by the first group of one or more conductors, the second insulation sheath comprising an inner layer of organic compound material overlaid by an outer layer of magnetic material;

(e) a third insulation sheath enclosing both the first and second insulation sheaths.

2. The hybrid cable of claim 1 wherein in the first insulation sheath the inner layer organic compound material is polyvinyl chloride and the outer layer magnetic material is barium ferrite.

3. The hybrid cable of claim 2 wherein the first insulation sheath includes the polyvinyl chloride inner layer having a minimum thickness of 20 mils and the barium ferrite outer layer having a minimum thickness of 30 mils.

4. The hybrid cable of claim 1 wherein the third insulation sheath comprises a layer of polyvinyl chloride having a minimum thickness of 35 mils.

5. The hybrid cable of claim 1 wherein in the second insulation sheath the organic compound material is polyvinyl chloride and the magnetic material is barium ferrite.

6. The hybrid cable of claim 5 wherein the second insulation sheath includes the polyvinyl chloride inner layer having a minimum thickness of 35 mils and the barium ferrite outer layer having a minimum thickness of 30 mils.

7. The hybrid cable of claim 1 wherein the first group of one or more conductors includes three individually insulated conductors for power transmission or power distribution and the second group of one or more conductors includes six twisted pairs of copper conductors for data and voice communications, each conductor of the six twisted pairs being individually insulated.

8. The hybrid cable of claim 1 wherein the first group of one or more conductors includes three individually insulated copper conductors for power transmission and/or distribution and the second group of one or more conductors includes fiber optic cable having four fiber strands.

9. The hybrid cable of claim 1 wherein the first group of one or more conductors includes three individually insulated conductors for power transmission or power distribution including a power conductor, a neutral conductor and an isolated grounding conductor.

10. The hybrid cable of claim 9 wherein the power conductor, the neutral conductor and the isolated grounding conductor are each insulated with a sheath comprising an inner layer of polyvinyl chloride overlaid by an outer layer of nylon.

11. A hybrid cable assembly including a hybrid cable and an outlet electrically coupled to one end of the cable, the cable electrically coupled between the outlet and a panel serving as a power source and data communications hub, the cable providing for power transmission or power distribution and data or voice communications between the panel and a computer workstation electrically coupled to the outlet, the hybrid cable assembly comprising:

(a) the hybrid cable including:

(1) a first group of one or more conductors for supplying power;

(2) a second group of one or more conductors for transmitting voice or data signals;

(3) a first insulation sheath enclosing the first group of one or more conductors for insulating the second group of one or more conductors from a magnetic field produced by the first group of one or more conductors, the first insulation sheath comprising an inner layer of organic compound material overlaid by an outer layer of magnetic material;

(4) a second insulation sheath enclosing the second group of one or more conductors for additionally insulating the second group of one or more conductors from the magnetic field produced by the first group of one or more conductors, the second insulation sheath comprising an inner layer of organic compound material overlaid by an outer layer of magnetic material; and (5) a third insulation sheath enclosing both the first and second insulation sheaths; and (b) the outlet including a case having an open side overlaid by a cover plate to define an interior region and a first female connector adapted to receive a male connector to supply power to a first computer workstation device is accessible through a first opening in the cover plate and a second female connector adapted to receive a male connector to permit transfer of data to the first computer workstation device is accessible through a second opening in the cover plate, the case including an interior barrier dividing the interior region into a power section and a data section, the power section including the first female power supply connector and the data section including the second female data transfer connector, the barrier comprising plastic and barium ferrite to insulate the data section from the power section.

12. The hybrid cable assembly of claim 11 wherein the outlet interior barrier further divides the interior region into a wiring section where an end section of the enters the case interior region, the first group of conductors being routed through a first opening in the interior barrier into the power section and electrically coupled to the first female power supply connector and the second group of conductors being routed through a second opening in the interior barrier into the data section and electrically coupled to the second female data transfer connector.

13. The hybrid cable assembly of claim 11 wherein the outlet additionally includes a third female connector adapted to receive a male connector to supply power to a second computer workstation devices is accessible through a third opening in the cover plate and a fourth female connector adapted to receive a male connector to permit transfer of data to the second computer workstation device is accessible through a fourth opening in the cover plate, the power section including the third female power supply connector and the data section including the fourth female data transfer connector.

14. A power and data communications network for providing power to a plurality of computer workstations, the network comprising:

(a) a panel functioning as a hub for data communications between the plurality of computer workstations and including connections for providing power to the computer workstations, the panel comprising a cabinet defining an interior region and including a panel interior barrier dividing the cabinet interior region into a power section and a data section, the power section including power supply connections and electrically coupled circuit breakers and the data section including a data service hub mounted on a service hub mounting pan, the panel barrier comprising plastic and barium ferrite to magnetically insulate the data section from magnet fields produced by circuitry in the power section;

(b) a hybrid cable including power transmission and/or distribution and data communications capability and having opposite ends electrically coupled to the panel and an outlet and for providing power from the panel to a computer workstation electrically coupled the outlet and providing for data transfer between the panel and the computer workstation, the hybrid cable including;

(i) a first group of one or more conductors for supplying power;

(ii) a second group of one or more conductors for transmitting voice or data signals;

(iii) a first insulation sheath enclosing the first group of one or more conductors for insulating the second group of one or more conductors from a magnetic field produced by the first group of one or more conductors, the first insulation sheath comprising an inner layer of organic compound material overlaid by an outer layer of magnetic material;

(iv) a second insulation sheath enclosing the second group of one or more conductors for additionally insulating the second group of one or more conductors from the magnetic field produced by the first group of one or more conductors, the second insulation sheath comprising an inner layer of organic compound material overlaid by an outer layer of magnetic material; and (v) a third insulation sheath enclosing both the first and second insulation sheaths.

15. The network of claim 14 wherein the first group of one or more conductors includes three individually insulated copper conductors for power transmission or power distribution and the second group of one or more conductors includes fiber optic cable having four fiber strands.

16. The network of claim 14 wherein in the first insulation sheath the inner layer organic compound material is polyvinyl chloride and the outer layer magnetic material is barium ferrite.

17. The network of claim 14 wherein in the second insulatibn sheath the organic compound material is polyvinyl chloride and the magnetic material is barium ferrite.

18. The network of claim 17 wherein the second insulation sheath includes the polyvinyl chloride inner layer having a minimum thickness of 35 mils and the barium ferrite outer layer having a minimum thickness of 30 mils.

19. The network of claim 14 wherein the first insulation sheath includes the polyvinyl chloride inner layer having a minimum thickness of 20 mils and the barium ferrite outer layer having a minimum thickness of 30 mils.

20. The network claim 14 wherein the third insulation sheath comprises a layer of polyvinyl chloride having a minimum thickness of 35 mils.

21. The network of claim 14 wherein the first group of one or more conductors includes three individually insulated conductors for power transmission and/or distribution and the second group of one or more conductors includes six twisted pairs of copper conductors for data and voice communications, each conductor of the six twisted pairs being individually insulated.

22. The network of claim 14 wherein the first group of one or more conductors includes three individually insulated conductors for power transmission or power distribution including a power conductor, a neutral conductor and an isolated grounding conductor.

23. The network of claim 22 wherein the power conductor, the neutral conductor and the isolated grounding conductor are each insulated with a sheath comprising an inner layer of polyvinyl chloride overlaid by an outer layer of nylon.

24. The network of claim 14 wherein the outlet includes a case having an open side overlaid by a cover plate to define an outlet interior region and a first female connector adapted to receive a male connector to supply power to a first computer workstation device is accessible through a first opening in the cover plate and a second female connector adapted to receive a male connector to permit transfer of data to the first computer workstation device is accessible through a second opening in the cover plate, the case including an outlet interior barrier dividing the outlet interior region into a power section and a data section, the power section including the first female power supply connector and the data section including the second female data transfer connector, the barrier comprising plastic and barium ferrite to insulate the data section from the power section.

25. The network of claim 24 wherein the outlet interior barrier further divides the interior region into a wiring section where an end section of the enters the case interior region, the first group of conductors being routed through a first opening in the interior barrier into the power section and electrically coupled to the first female power supply connector and the second group of conductors being routed through a second opening in the interior barrier into the data section and electrically coupled to the second female data transfer connector.

26. The network of claim 24 wherein the outlet additionally includes a third female connector adapted to receive a male connector to supply power to a second computer workstation device is accessible through a third opening in the cover plate and a fourth female connector adapted to receive a male connector to permit transfer of data to the second computer workstation device is accessible through a fourth opening in the cover plate, the power section including the third female power supply connector and the data section including the fourth female data transfer connector.

* * * * *